US006200228B1

(12) United States Patent
Takeda

(10) Patent No.: US 6,200,228 B1
(45) **Date of Patent: *Mar. 13, 2001**

(54) GOLF CLUB AND METHOD FOR MANUFACTURING THE SAME

(75) Inventor: Hitoshi Takeda, Tsubame (JP)

(73) Assignee: K.K. Endo Seisakusho, Niigata-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,275

(22) Filed: Jun. 9, 1998

(30) Foreign Application Priority Data

Jun. 16, 1997 (JP) ..... 9-158479

(51) Int. Cl.[7] ..... A63B 53/04
(52) U.S. Cl. ..... 473/324; 473/342; 473/349
(58) Field of Search ..... 473/324, 349, 473/350, 342, 409; 29/522.1, 447

(56) References Cited

U.S. PATENT DOCUMENTS 4,852,880 * 8/1989 Kobayashi ..... 473/349
5,411,264 * 5/1995 Oku ..... 473/342
5,522,593 * 6/1996 Kobayashi et al. ..... 473/349
5,613,917 * 3/1997 Kobayashi et al. ..... 473/335
5,658,208 * 8/1997 Shimasaki ..... 473/349
5,749,794 * 5/1998 Kobayashi et al. ..... 473/342
5,766,091 * 6/1998 Humphrey et al. ..... 473/324
5,774,970 * 7/1998 Huang ..... 29/447

FOREIGN PATENT DOCUMENTS 8-38657 2/1996 (JP) .

* cited by examiner

*Primary Examiner*—Kien T. Nguyen
(74) *Attorney, Agent, or Firm*—Quarles & Brady LLP

(57) ABSTRACT

A golf club such as an iron golf club comprising a head body with a cavity formed on the rear surface thereof and a back member securely fitted into the cavity, with the both closely contacted each other. Prior to securing a back member 9 to a cavity 8 formed on the rear surface 7 of the head body 6, the back member 9 is heated to a high temperature. The temperature is set at about 750 degrees centigrade, approximated to standard finishing forging temperature if the member 9 is made of titanium or titanium alloy. As the back member 9 is fitted through deformation processing with the same being heated to the high temperature, the flow stress of the metallic material of the back member 9 can be lowered, thus enhancing ductility thereof. As a result, a front surface 14 and a peripheral surface 15 can be closely contacted by the cavity 8 without gaps, so that the back member 9 can be rigidly secured to the cavity 8. Thus the strength of the head is improved to enable the thickness of the face 4 to be made thinner.

8 Claims, 12 Drawing Sheets

(a) (b)

(a) (b)

GOLF CLUB AND METHOD FOR MANUFACTURING THE SAME

BACKGROUND OF INVENTION

1. Field of Invention

The present invention relates to a golf club comprising a head with a shaft connected therewith, said head being formed by integrating a plurality of members made of different metal into one piece by fitting the members to one another. The present invention also relates to a method for manufacturing the above-structured golf club.

2. Prior Art

Typically, a golf club consists of a shaft and a clubhead and is normally classified into three types, i.e., wood, iron and putter. Iron club head, for example, is further classified by an angle of a loft (or loft angle). Iron clubs with small loft angles (20 to 30 degrees for example) are called a long iron, while those with large loft angle (40 to 50 degrees for example) a short iron club.

Generally, iron clubs are numbered in sequence from a shorter iron to a longer iron, such as the 1st, 2nd, 3rd, 4th, 5th, 6th, 7th, 8th, 9th, PW (pitching wedge), SW (sand wedge) and LW (lob wedge) in sequence.

A clubhead of an iron club has a face at its front face for hitting a golf ball and a back on its rear face. Some of such backs have cavities, others have smoothed surfaces. Every face has an area named a sweet spot, which is an area on the face that brings about the most satisfactory result when hitting a golf ball.

So-called cavity back irons (iron clubs that have cavities at their backs) have a sweet spot larger than so-called solid back irons (iron clubs whose backs are smoothed surfaces, sometimes called muscle types). On the other hand, solid back irons are advantageous in hitting strong balls, to obtain a comparatively straight travelling of balls that are not influenced by the wind with a good spin.

For iron heads, for example, there is disclosed in paragraphs 0009 and 0011 of Japanese Patent Un-Examined Publication No.8-38657 a golf club head which comprises a head body having a hosel made of metal of the relatively large specific gravity such as steel, beryllium copper alloy or the like, a cavity provided on a back surface of the head body, and a back member made of metal of the relatively small specific gravity such as titanium, aluminum or the like, said back member being pressed into said cavity, so that it is secured to the head body.

According to such conventional art, as the head body and the back member are secured to each other by pressing the latter into the former at a normal temperature, a gap is prone to be produced in a joint surface therebetween, thus resulting in a problem of the deterioration of strength. This is due to the insufficient amount of plastic deformation that would occur when the back member is pressed into the cavity. Therefore, you had to make a thickness of the face member comparatively great, for example as thick as about 3.5 mm to ensure its strength.

SUMMARY OF THE INVENTION

To eliminate the above problems, it is, therefore, an object of the invention to provide a golf club such as an iron golf club whose head is formed by securing different metallic members to one another through plastic deformation, without any gaps between the contact surfaces of the members, thus enabling one to make a face thinner to improve a degree of freedom.

To attain the above object, a gold club head constructed by a plurality of different metallic members integrally fitted one another comprises a head integrated by fitting together a plurality of members each of which being made of different metal and a shaft connected to the head, said members being either a passive fitting member or an active fitting member, wherein the members are fitted together through deformation processing with at least one of the passive and active members being heated to a higher temperature than a normal temperature.

DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Figure 1:
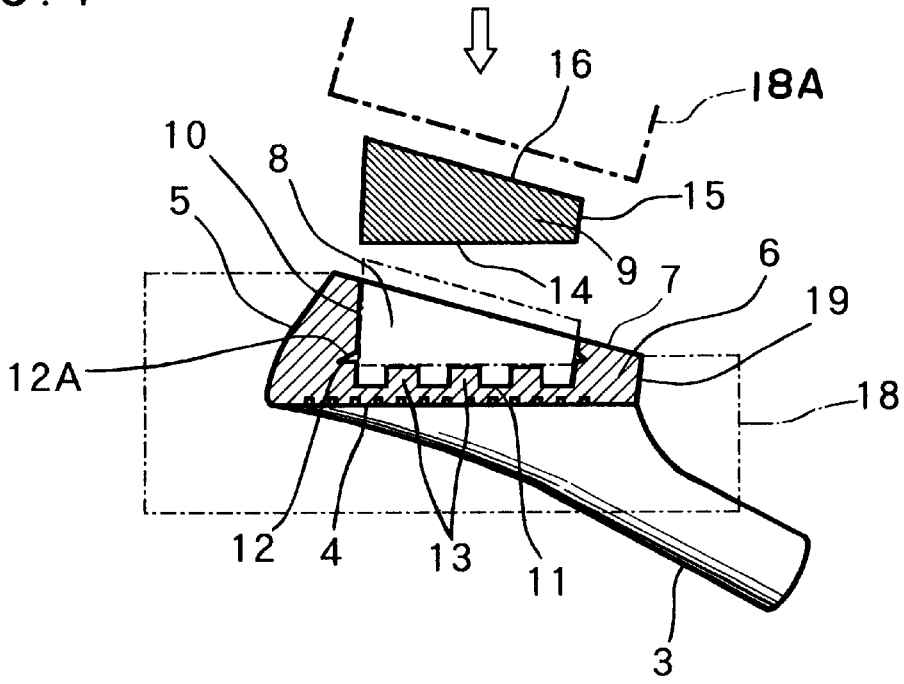
FIG. 1 is a section of a golf club of a first embodiment of the invention, which is being manufactured.
Figure 2:
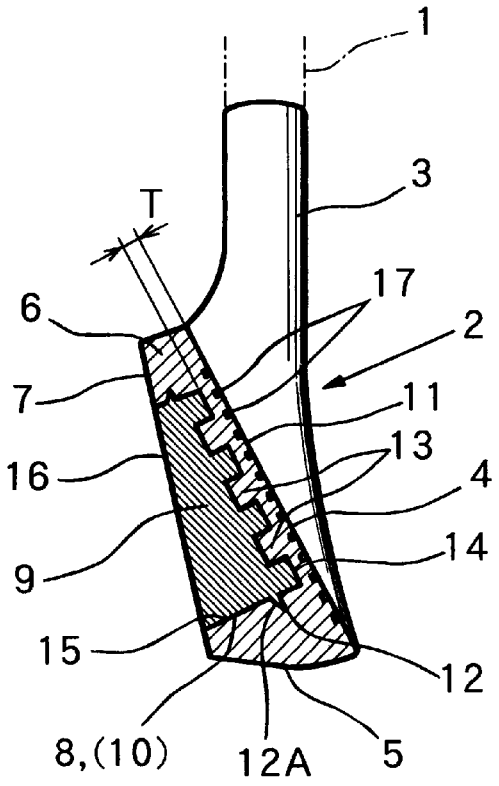
FIG. 2 is a section of a head of a first embodiment of the invention.
Figure 3:
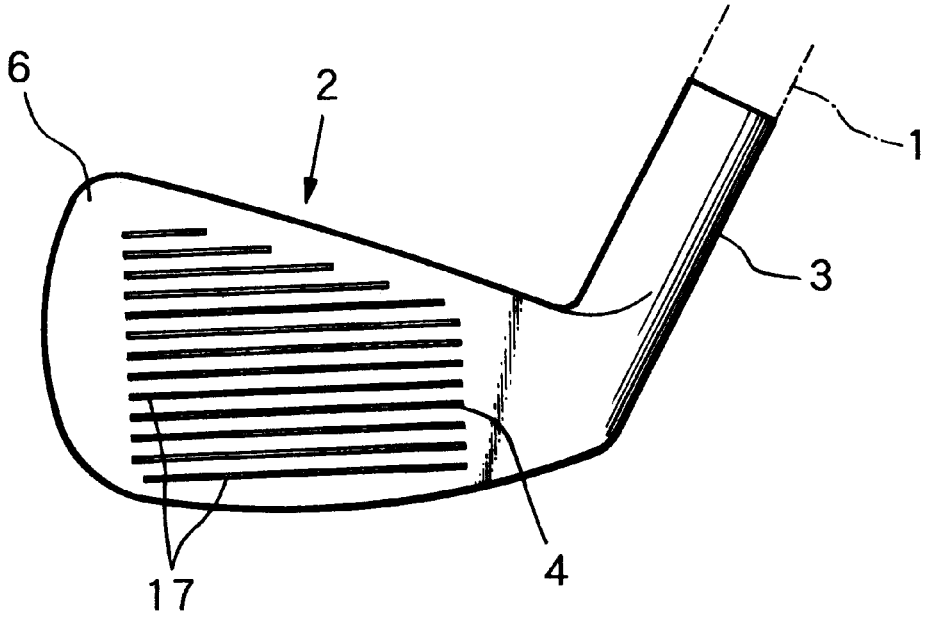
FIG. 3 is a front view of a head of a first embodiment of the invention, which is being manufactured.
Figure 4:
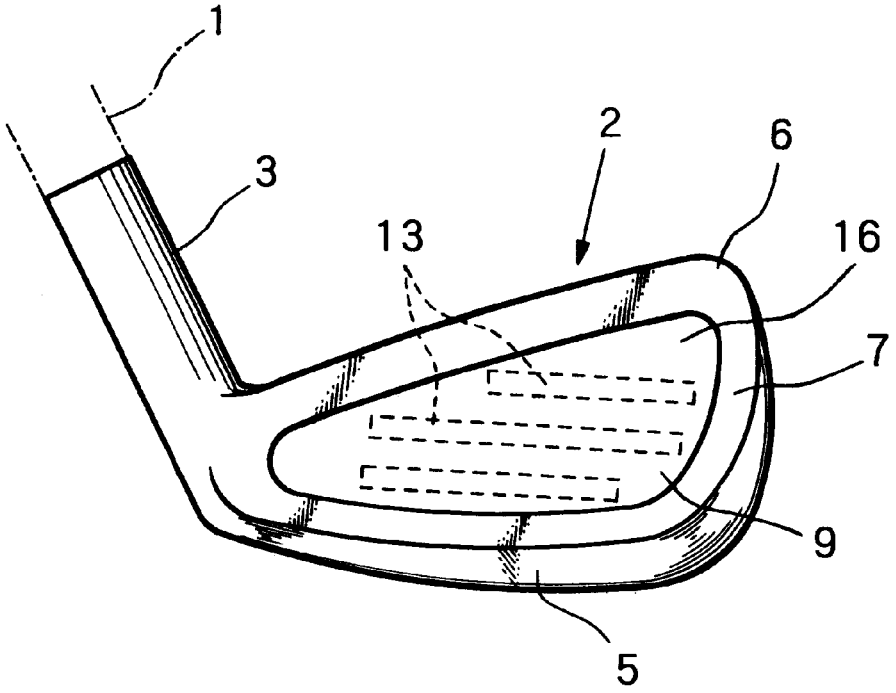
FIG. 4 is a rear view of a head of a first embodiment of the invention.

Hereinafter is described a first embodiment of the invention with reference to FIGS. 1 to 4. As shown in FIGS. 2 to 4, reference numeral 1 designates a shaft having a grip (not shown) at its upper end, while reference numeral 2 designates a head which is connected to the lower end of the shaft 1, said head 1 comprising a hosel 3 protruded from one end thereof for connecting the shaft 1 thereto, a head body 6 having a face 4 at its front and a sole 5 at its bottom, said head body 6 being defined as a passive member to which is another member fitted, having a cavity 8 formed in nearly the center of its back surface 7, and a back member 9 or an active member for fitting the same into the cavity 8.

These head body 6 and back member 9 are each formed by means of hot or cold forging of hereinbelow described different metallic members. For example, if the head body 6 is made of beryllium copper alloy, stainless steel, S20C steel or the like, the back member 9 is made of (pure) titanium, titanium alloy, aluminum or aluminum alloy, whereby the back member 9 is made of a material having less specific gravity than the head body 6. In the meantime, the above-mentioned hot forging is a method of processing for molding through forging metallic material heated at a high temperature, while the cold forging is the one for molding through forging metallic material under normal temperature.

The cavity 8 is formed simultaneously or nearly simultaneously with the manufacture of the head body 6 by forging, said cavity 8 having a peripheral surface 10 nearly perpendicular to the face 4 and a bottom surface 11 formed nearly parallel to the face 4. The peripheral surface 10 is provided with a slanted surface 12A which is gradually widened as it comes closer to the face 4, thus forming a triangle-shaped small recess 12. The small recess 12 is formed by mechanical means such as machining or grinding, after the cavity 8 is formed by forging. The bottom surface 11 is formed with a plurality of convex bars 13 which are laterally elongated and vertically spaced one another, protruding toward the back surface 7 of the head body 6.

In this embodiment, the back member 9 that is in a state of a high temperature is fitted into the cavity 8 of the head body 6 that is in a state of a normal temperature through a deformation processing, with a front surface 14 of the back member 9 being fitted to the bottom surface 11 formed with the convex bars 13, a peripheral surface 15 thereof being fitted to the peripheral surface 10 provided with the small recess 12, and a back surface 16 thereof being nearly flush with the said back surface 7, respectively. Incidentally, reference numeral 17 designates lateral grooves called score lines, which are provided on the face 4, running thereon in parallel.

Hereinafter is explained a method of manufacturing the above-mentioned head 2.

As shown in FIG. 2, the head body 6 that is formed in advance with the cavity 8 and the small recess 12 is placed in a cavity 19 of a lower mold 18, and then, the back member 9 is placed in the cavity 8, and thereafter is pressed thereinto, applying pressure thereto with the use of an upper mold 18A. At that time, the back member 9 is preheated and then press-fitted. Means for heating the back member 9 may be a direct heating means such as a heating furnace in which it is housed to be directly heated there, or may be an indirect heating means such that the said upper mold 18A is preheated using a certain heater, and then, the back member 9 is placed therein. Thus, the flow stress of metal material of the back member 9 is able to be lowered to enhance the ductility thereof. Although the heating temperature depends on the kinds of metallic materials, which is desirably approximated to a standard finishing temperature for forging, preferably about 750 degrees centigrade for pure titanium or titanium alloy, and about 260 degrees centigrade for aluminum or aluminum alloy.

Accordingly, when the back member 9 is preheated and then housed in the cavity 8, applying pressure using the upper mold 18A, the front surface 14 thereof is subjected to plastic deformation so that it closely contacts the bottom surface 11 to be fitted to the convex bars 13, at the same time the peripheral surface 15 also is subjected to plastic deformation to be fitted into the small recess 12, thereby rigidly securing the head body 6 to the back member 9. Alternatively, the head body 6 and the back member 9 may be formed by other process than forging, such as machining or casting.

According to a first embodiment of the invention, when securing the back member 9 to the cavity 8 formed in the back surface 7 of the head body 6 using plastic deformation, the back member 9 is preheated at a high temperature to be plastically deformable, so that the flow stress of the metallic material of the back member 9 is lowered to enhance the ductility thereof. Therefore, the front face 14 and the peripheral surface 15 are able to be tightly fitted into the cavity 8 without gaps, so that the back member 9 can be rigidly secured to the cavity 8. Thus, the thickness T of the face 4, for example, can be made as thin as about 2 mm.

Further, as the back member 9 is preheated to be rigidly secured by deformation processing, the flow stress of the metallic material can be lowered to enhance the ductility thereof despite the small recess 12 formed in the peripheral surface 10 of the cavity 8. Thus, the peripheral surface 15 of the back member 9 can be closely and tightly fitted to the bottom surface 11 formed with the convex bars 13, with the peripheral surface 15 also being closely and tightly fitted into the small recess 12 due to plastic deformation, thereby more rigidly securing the head body 6 to the back member 9.

Specifically, the two components are rigidly united together through deformation processing by preheating at least one of them to a high temperature so as to insure the strength of the head 2 itself resulting from the improved connection strength therebetween, whereby the thickness T of the face 4 can be minimized, as thin as about 2 mm. Accordingly, the depth of the cavity 8 can be made greater, while the head body 6 can be formed of metallic material of a larger specific gravity, such as beryllium copper alloy, stainless steel, S20C steel or the like, while the back member 9 can be formed of that of the smaller specific gravity such as pure titanium, titanium alloy, aluminum, aluminum alloy or the like, thus allowing the thickness of the sole 5 to be made greater in order to position the center of gravity of the head 2 as backward as possible. As a result, you can obtain a golf club with a greater moment of inertia as well as an enlarged sweat spot, with less unstableness of the head 2 in striking golf balls.

Furthermore, as the back surface 7 of the head 2 is nearly flush with the back surface 16 of the back member 9, in other words, it becomes from its appearance like a solid back type (or muscle back type), the thickness of the head 2 can be insured so that a comparatively straight travelling of a ball can be obtained without being influenced by the wind, with a good spin and excellent feeling in striking.

Moreover, as the back member 9 is secured to the head body 6 that is integral with the hosel 3 for connecting the shaft 1 thereto, the swinging force from the shaft 1 can be transferred directly to the head 2 across the hosel 3, thus improving its strength. Also, the temperature in fitting the back member 9 is about 750 degrees centigrade for pure titanium or titanium alloy, while about 260 degrees centigrade for aluminum or aluminum alloy, whereby it is approximated to the standard finishing temperature in forging the respective metal, so that the back member 9 can be made unlikely to be recrystallized, eliminating a fear of the degradation of strength.

In addition, the embodiment of the invention is advantageous in that the heating of the back member 9 to a predetermined temperature is insured, using either a direct heating means for directly heating the same by housing it in a heating furnace, or an indirect heating means for indirectly heating the same by preheating the upper mold 18A with certain heater then placing the back member 9 in the upper mold 18A.

Next, a second embodiment of the invention will be explained with reference to FIGS. 5 to 7, in which the same reference numerals as those in the forgoing embodiment will be designated as the common reference numerals, and their repeated detailed description will be omitted.

Figure 6:
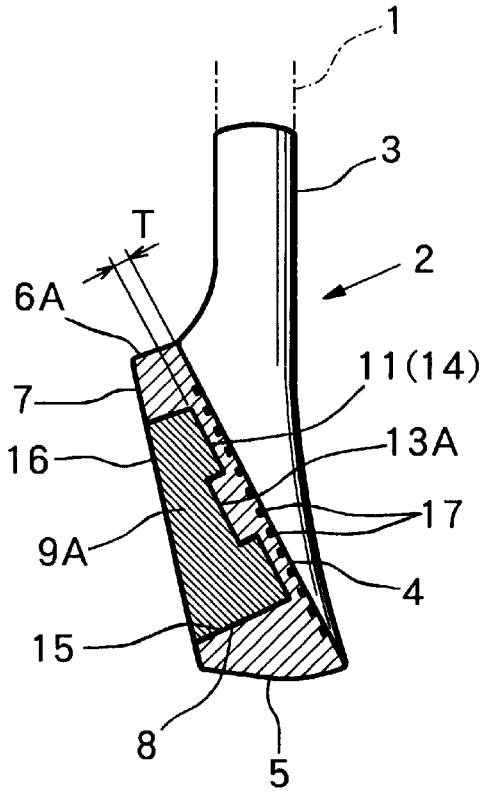
FIG. 6 is a section of a head of a second embodiment of the invention.
Figure 7:
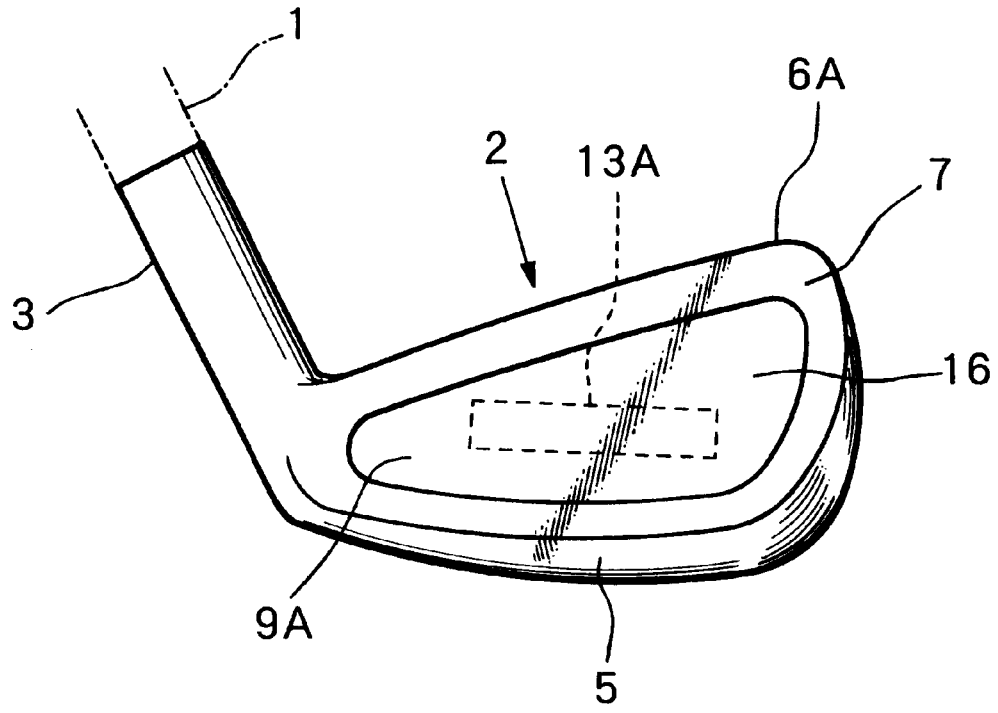
FIG. 7 is a rear view of a head of a second embodiment of the invention.

In a second embodiment, a convex bar 13A is formed on the bottom surface 11 of the cavity 8 formed in nearly the center of the back surface 7 of the head body 6A, as illustrated in FIGS. 6 and 7, while a back member 9A slightly larger than the cavity 8 is fitted into the cavity 8. At that time, the back member 9A is preheated to be fitted into the cavity 8.

Figure 5:
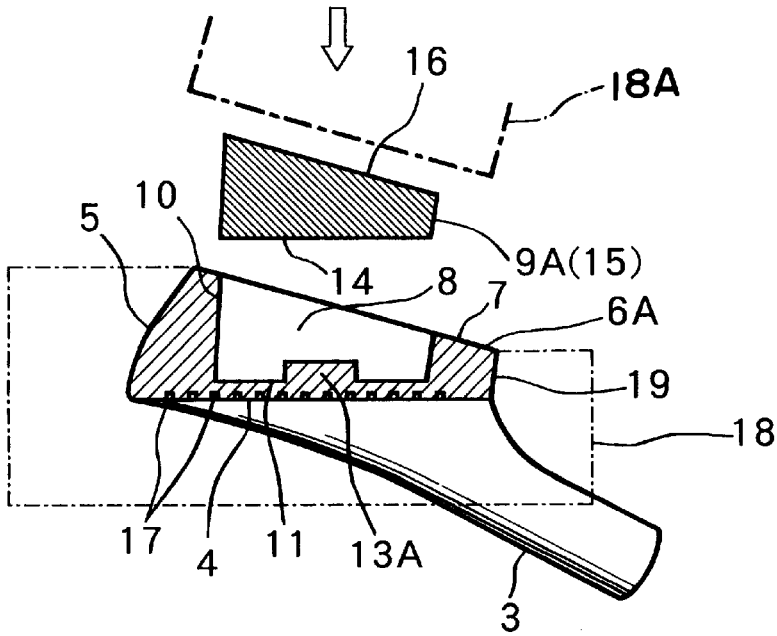
FIG. 5 is a section of a golf club of a second embodiment of the invention, which is being manufactured.

Referring to FIG. 5 showing a manufacturing method, the head body 6A having the cavity 8 formed in advance by forging is placed in the cavity 19 of the lower mold 18, and then, the back member 9A formed in advance by forging is pressed into the cavity 8 using the upper mold 18A, applying pressure thereto. At that time, the back member 9A is preheated to a predetermined high temperature, to be rigidly secured thereto. Accordingly, the flow stress or deformation resistance of the metallic material of the preheated back member 9A can be lowered, thus enhancing the ductility thereof, so that the front surface 14 and peripheral surface 15 of the back member 9A can be very closely and tightly fitted into the peripheral surface 10 and bottom surface 11 of the cavity 8, respectively.

According to a second embodiment of the invention, the back member 9A thus preheated is, like a first embodiment, subjected to plastic deformation in the cavity 8, thereby lowering the flow stress of the metallic material thereof to enhance the ductility thereof, so that both can be rigidly and closely secured each other. Specifically, as the back member 9A is rigidly secured by deformation processing with the same being heated so that the strength of the head 2 itself is insured due to the improved connection strength, the thickness T of the face 4 can be minimized, as thin as about 2 mm. Accordingly, the depth of the cavity 8 can be made greater, while the head body 6A can be formed of metallic material of a larger specific gravity, such as beryllium copper alloy, stainless steel, S20C steel or the like, while the back member 9A can be formed of that of a smaller specific gravity such as pure titanium, titanium alloy, aluminum, aluminum alloy or the like, thus allowing the thickness of the sole 5 to be made greater in order to position the center of gravity of the head 2 as backward as possible. As a result, you can obtain a golf club with a greater moment of inertia as well as an enlarged sweat spot, with less unstableness of the head 2 in striking golf balls. Furthermore, as the back surface 7 of the head body 6A is nearly flush with the back surface 16 of the back member 9A, in other words, it becomes from its appearance like a solid back type (or muscle back type), the thickness of the head 2 can be insured so that a comparatively straight travelling of a ball can be obtained without being influenced by the wind, with a good spin and excellent feeling in striking.

Hereinafter will be explained other embodiments of the invention, in which the same portions as those in the foregoing embodiments are designated as common numerals, and their detailed descriptions will be omitted.

Figure 8:
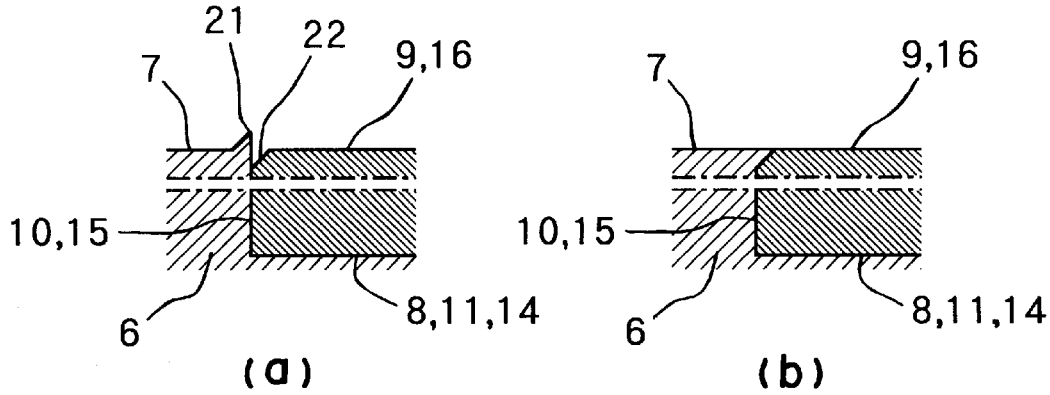
FIG. 8 is a section of a golf club of a third embodiment of the invention, in which FIG. 8(*a*) illustrates a section prior to securing, while FIG. 8(*b*) a section after securing.

Referring to FIG. 8 showing a third embodiment of the invention, the upper end of the peripheral surface 10 is formed with a protrusion 21, while the edge of the back surface 16 is formed with a cutout 22. Then, the head body 6, particularly the neighborhood of the protrusion 21 is heated to a standard finishing temperature for forging, i.e., about 800 to 850 degrees centigrade for carbon steel, about 900 degrees centigrade for stainless steel, and about 750 degrees centigrade for copper alloy, then the back member 9 is housed in the cavity 8 while the protrusion 21 is collapsed to fill the cutout 22 therewith, so that the both are secured each other. This embodiment is advantageous in that the above securing is insured with less resistance because the neighborhood of the protrusion 21 is heated to a standard finishing temperature for forging.

Figure 9:
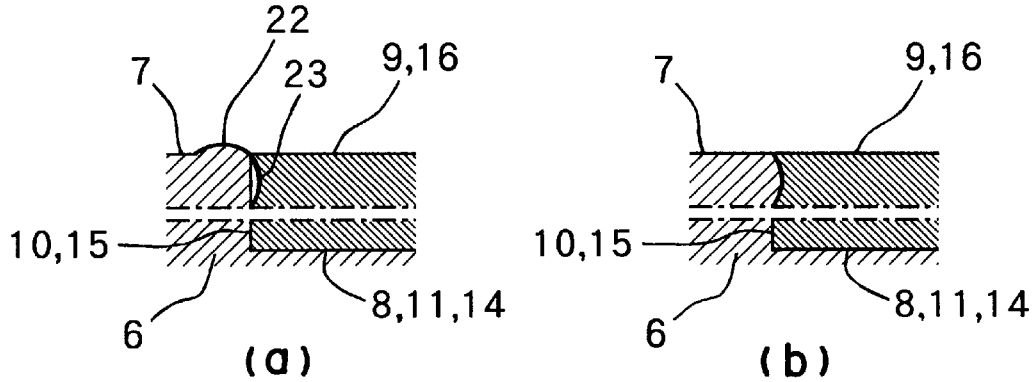
FIG. 9 is a section of a golf club of a fourth embodiment of the invention, in which FIG. 9(*a*) illustrates a section prior to securing, while FIG. 9(*b*) a section after securing.

Referring to FIG. 9 showing a fourth embodiment of the invention, the neighborhood of the upper end of the peripheral surface 10 is formed with a convex portion 22, while the peripheral surface 15 is formed with a recess 23. Then, both the head body 6 and the back member 9 are heated in advance to standard finishing temperature for forging, and thereafter, the back member 9 is housed in the cavity 8 while the convex portion 22 is collapsed to fill the recess 23 therewith, so that the both are secured each other. This embodiment is advantageous in that the above securing is insured with less resistance because both of the head body 6 and the back member 9 are heated in advance to respective standard finishing temperature for forging.

Figure 10:
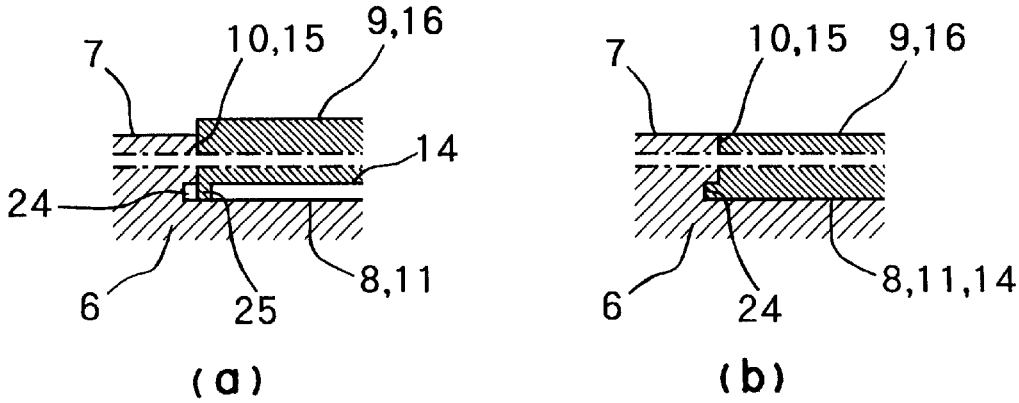
FIG. 10 is a section of a golf club of a fifth embodiment of the invention, in which FIG. 10(*a*) illustrates a section prior to securing, while FIG. 10(*b*) a section after securing.

Referring to FIG. 10 showing a fifth embodiment of the invention, a recess 24 is formed in advance adjacent the lower end of the peripheral surface 10, while the front surface 14 is formed in advance with a protrusion 25 extending downwardly. Then, with both the head body 6 and the back member 9 being heated in advance to a respective standard finishing temperature for forging, the back member 9 is housed in the cavity 8 while the protrusion 25 is collapsed by pressing the back member 9 to fill the recess 24 therewith, so that the both are secured each other. This embodiment is also advantageous in that the above securing is insured with less resistance because both of the head body 6 and the back member 9 are heated in advance to respective standard finishing temperature for forging.

Figure 11:
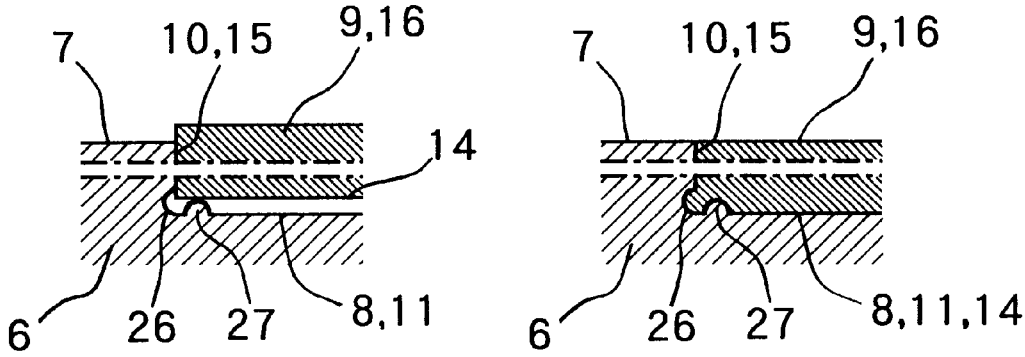
FIG. 11 is a section of a golf club of a sixth embodiment of the invention, in which FIG. 11(*a*) illustrates a section prior to securing, while FIG. 11(*b*) a section after securing.

Referring to FIG. 11 showing a sixth embodiment of the invention, a recess 26 is formed in advance adjacent the lower end of the peripheral surface 10, while the bottom surface 11 is formed in advance with a protrusion 27 extending upwardly. Then, with both the head body 6 and the back member 9 being heated in advance to a respective standard finishing temperature for forging, the back member 9 is housed in the cavity 8 while the protrusion 27 is collapsed by pressing the back member 9 to fill the recess 26 therewith, so that the both are secured each other. This embodiment is also advantageous in that the above securing is insured with less resistance because both of the head body 6 and the back member 9 are heated in advance to respective standard finishing temperature for forging.

Figure 12:
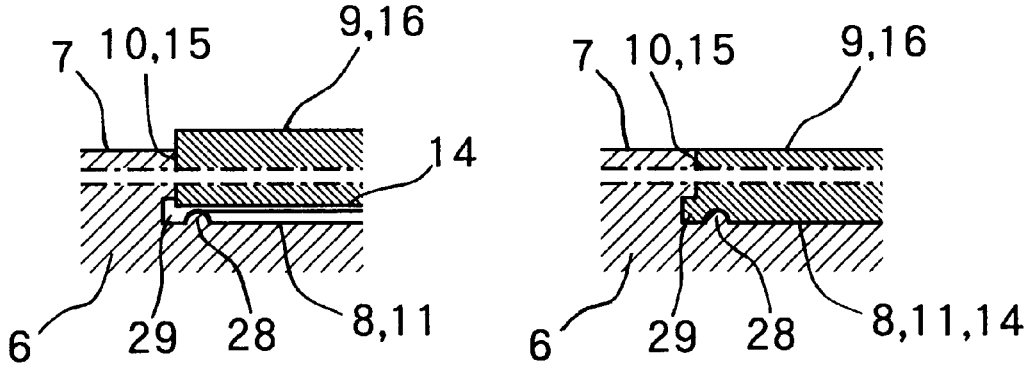
FIG. 12 is a section of a golf club of a seventh embodiment of the invention, in which FIG. 12(*a*) illustrates a section prior to securing, while FIG. 12(*b*) a section after securing.

Referring further to FIG. 12 showing a seventh embodiment of the invention, a ring-shaped protrusion 28 is formed in advance on either the bottom surface 11 or the front surface 14, while the lower end of the bottom surface 11 is formed in advance with a recess 29. Then, with both the head body 6 and the back member 9 being heated in advance to a respective standard finishing temperature for forging, the back member 9 is housed in the cavity 8 while the protrusion 28 is collapsed by pressing the back member 9 to fill the recess 29 therewith, so that the both are secured each other. This embodiment is also advantageous in that the above securing is insured with less resistance because both of the head body 6 and the back member 9 are heated in advance to respective standard finishing temperature for forging.

Figure 13:
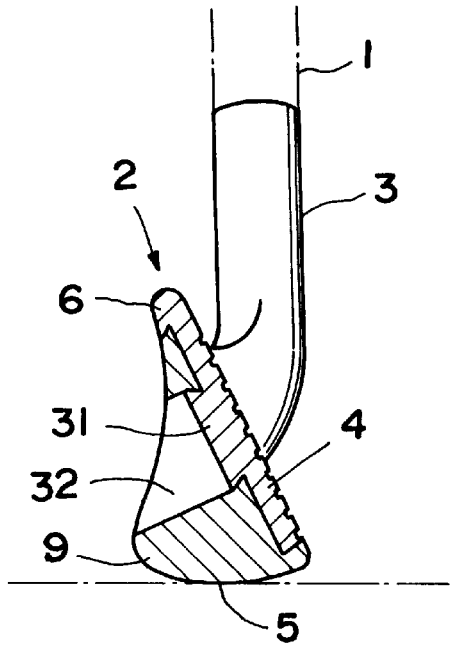
FIG. 13 is a section of a golf club of an eighth embodiment of the invention.
Figure 14:
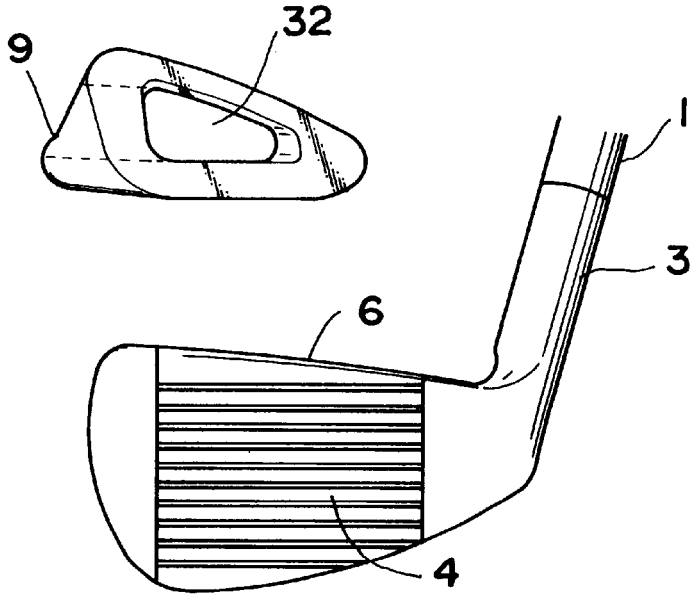
FIG. 14 is an exploded perspective view of a golf club of an eighth embodiment of the invention.

In FIGS. 13 and 14 showing an eighth embodiment of the invention, the back member 9 is secured to the rear surface of the head body 6 having the face 4 and the hosel 3. The rear surface of the face 4 is formed with a convex portion 31, to which is press-fitted a through-hole 32 of the back member 9 in a mortise/tenon manner, with the back member 9 being heated to a high temperature, subjected to plastic deformation, thereby securing it to the head body 6 that is at a normal temperature. Accordingly, the back member 9 is able to be closely and tightly secured to the rear surface of the face 4, so that their connection strength can be improved.

Figure 15:
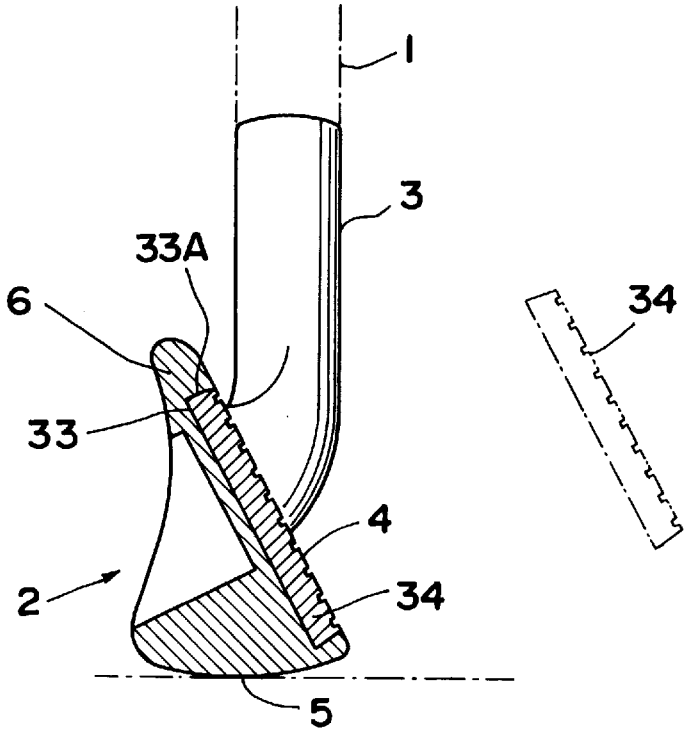
FIG. 15 is a section of a golf club of a ninth embodiment of the invention.

In FIG. 15 showing a ninth embodiment, the front surface of the head body 6 having the hosel 3 and the sole 5 is formed with a recess 33 opposite to the face 4, into which is press-fitted an active fitting member or face member 34 made of titanium or titanium alloy approximately at a finishing temperature for forging, whereby the face member 34 is secured to the head body 6 through deformation processing. In this case, a peripheral surface 33A of the recess 33 is reverse-tapered, in other words, the width of its aperture is smaller near the face 4 side than the bottom side thereof, so that after the face member 34 is pressed into the recess 33, it is secured thereto with its width at the bottom side being larger than at the face 4 side. Accordingly, the face member 34 is closely and tightly contacted by the recess 33, thereby improving the connection strength.

Figure 16:
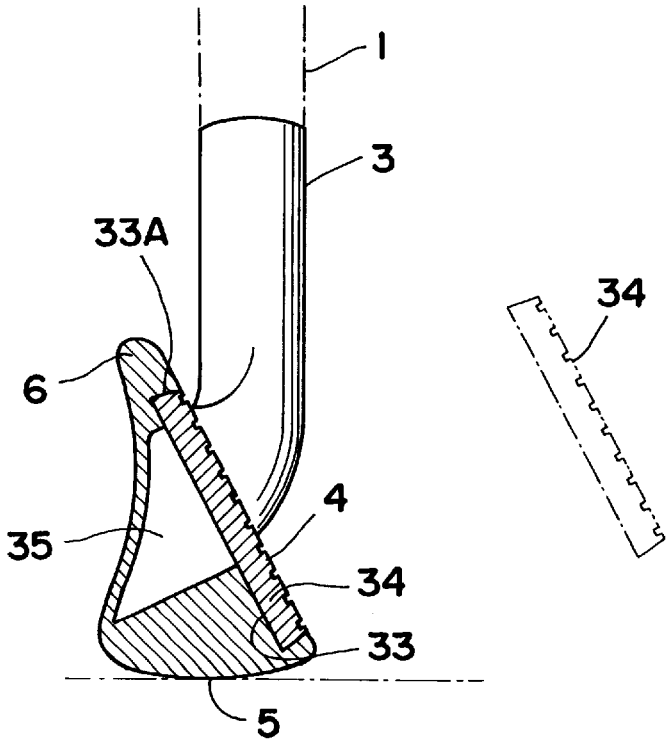
FIG. 16 is a section of a golf club of a tenth embodiment of the invention.

Referring to FIG. 16 showing a tenth embodiment, the front surface of the head body 6 having the hosel 3 and the sole 5 is formed with a recess 33 opposite to the face 4, said head body 6 including a hollow portion 35 rearwardly of the recess 33, into which is press-fitted the face member 34 made of titanium or titanium alloy heated at approximately finishing temperature for forging, whereby the face member 34 is secured to the head body 6 through plastic deformation. In this case also, a peripheral surface 33A of the recess 33 is reverse-tapered, so that after the face member 34 is pressed into the recess 33, it is secured thereto with its width being larger at the bottom side than at the face 4 side. Accordingly, the face member 34 is closely and tightly contacted by the recess 33, thereby improving the connection strength.

Figure 17:
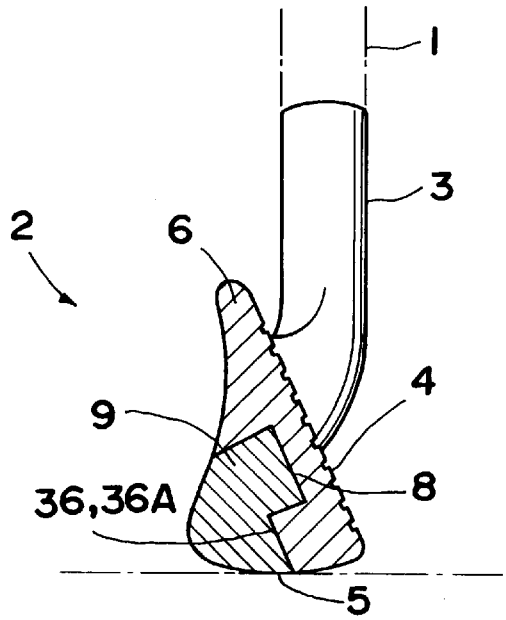
FIG. 17 is a section of a golf club of an eleventh embodiment of the invention.
Figure 18:
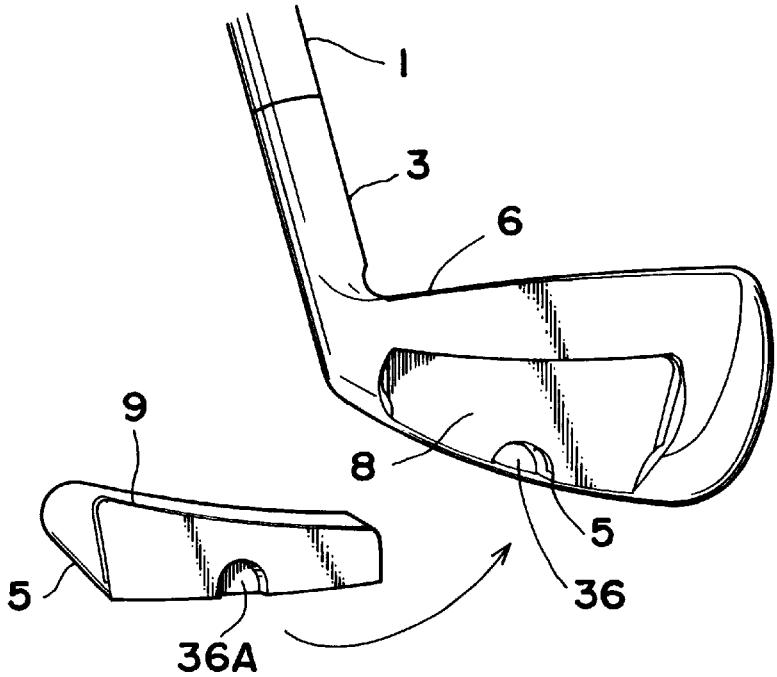
FIG. 18 is an exploded perspective view of a golf club of an eleventh embodiment of the invention.

In FIGS. 17 and 18 showing an eleventh embodiment of the invention, the rear surface of the head body 6 having the hosel 3, the face 4 and the front portion of the sole 5 is formed with the cavity 8, into which is press-fitted the back member 9 that is heated at approximately finishing temperature for forging, whereby the back member 9 is secured to the head body 6 through plastic deformation. The lower part of the back member 9 is formed with the rear portion of the sole 5. The lower part of the aforesaid rear surface is formed with a small projection 36, which is fitted into a small recess 36A formed at the lower part of the front surface of the back member 9, simultaneously with the above securing of the back member 9 to the head body through plastic deformation. Thus, the back member 9 and the small recess 36A are closely and tightly contacted by the cavity 8 and the small projection 36 respectively, so that the connection strength can be improved.

Figure 19:
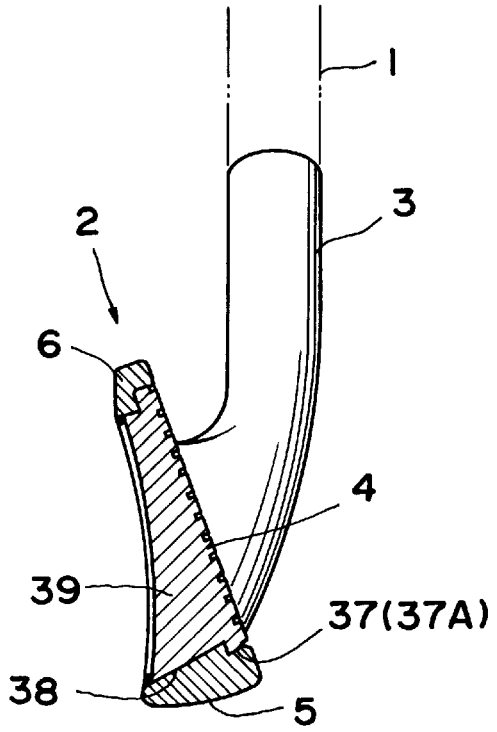
FIG. 19 is a section of a golf club of a twelfth embodiment of the invention.

In FIGS. 19 showing a twelfth embodiment of the invention, the head body 6 formed with the hosel 3 and the sole 5 is provided with a recess 37 positioned opposite to the face 4, said recess 37 being formed with a through-hole 38 in the center thereof, extending rearward. Then, a face member 39 heated at approximately finishing forging temperature is press-fitted into the recess 37 to securely fit the face member 39 to the head body 6 by plastic deformation. In this case also, a peripheral surface 37A of the recess 37 is reverse-tapered so that its width is smaller at the face 4 side. Thus, the face member 39, having such a large thickness that it reaches nearly the rear side of the head body 6, is pressed into the recess 37, with the peripheral surface 37A being wider at its bottom side than at the face 4 side. Accordingly, the face member 39 can be closely contacted by the recess 37, thereby improving the connection strength between the head body 6 and the face member 39.

Figure 20:
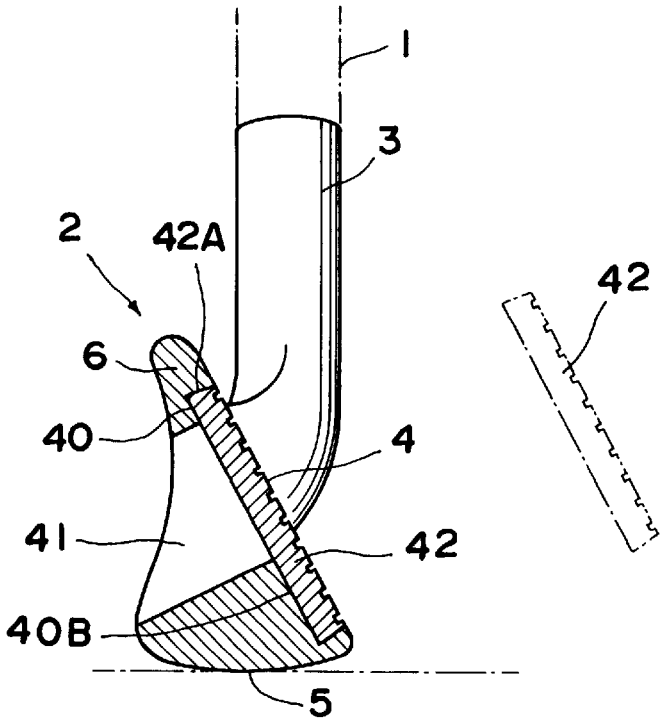
FIG. 20 is a section of a golf club of a thirteenth embodiment of the invention.

Referring to FIG. 20 showing a thirteenth embodiment of the invention, the head body 6 having the hosel 3 and the sole 5 is provided with a recess 40 positioned opposite to the face 4, said recess 40 being formed with a through-hole 41 in the center thereof, extending rearward. Then, a thin and tabular face member 42 that is made of titanium, titanium alloy or the like, heated at approximately finishing forging temperature, is press-fitted into the recess 40 to securely fit the face member 42 to the head body 6 by plastic deformation. In this case also, a peripheral surface 40A of the recess 40 is reverse-tapered so that its width is smaller at the face 4 side. Thus, the face member 42 is pressed into the recess 40, with the peripheral surface 40A being wider at its bottom side than at the face 4 side. Accordingly, the face member 42 can be closely contacted by the recess 40, thereby improving the connection strength between the head body 6 and the face member 42. As a result, you can make the thickness of the face member 42 smaller, so that the position of the center of gravity of the head 2 as well as the weight balance thereof is able to be free to choose. Further, the peripheral edge 40A at the rear side of the face member 42 abuts upon a bottom portion 40B of the recess 40, thereby insuring the receiving of the shocks or impacts applied to the face member 42 when striking balls.

Figure 21:
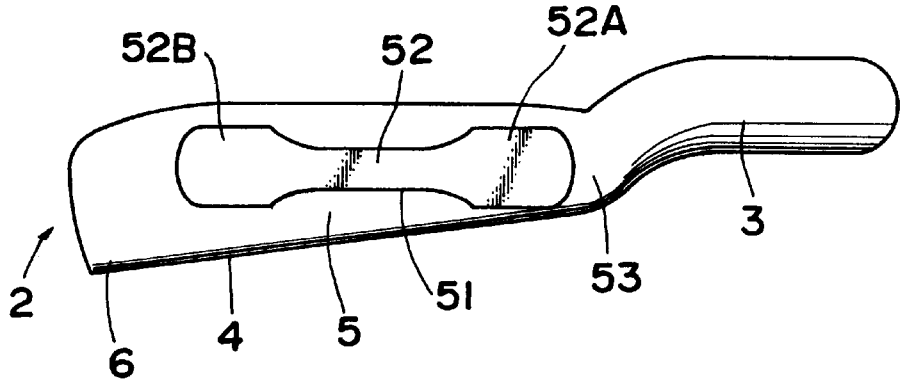
FIG. 21 is a bottom view of a golf club of a fourteenth embodiment of the invention.
Figure 22:
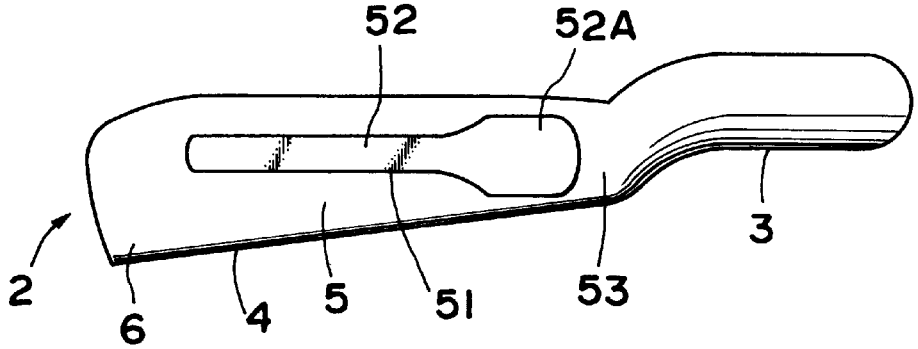
FIG. 22 is a bottom view of a golf club of a fifteenth embodiment of the invention.
Figure 23:
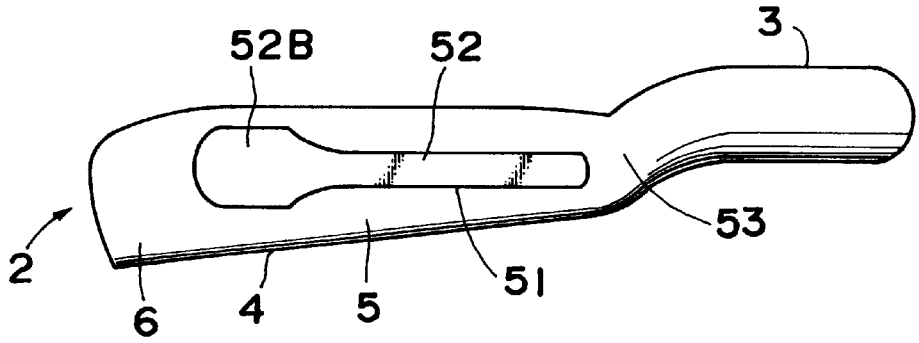
FIG. 23 is a bottom view of a golf club of a sixteenth embodiment of the invention.

Referring to FIGS. 21 to 23 showing fourteenth to sixteenth embodiments of the invention, the sole 5 of the head body 6 formed with the hosel 3 is provided with a recess 51 elongated along the longitudinal direction of the sole 5. Then, a block-shaped sole member 52 that is made of metal having the larger specific gravity than that of the head body 6, heated at approximately its finishing forging temperature, is press-fitted into the recess 51 to securely fit the sole member 52 to the head body 6 by plastic deformation. In this case, the sole member 52 provided in the sole 5 allows the center of gravity of the head 2 to be positioned downward, so that the depth of the center of gravity of the head 2, in other words, the distance between the face 4 and the center of gravity of the head 2 can be made longer, thus enabling the enlarging of the sweat area.

Specifically referring to FIG. 21 showing a fourteenth embodiment, the sole member 52 is formed at both ends of the longitudinal length of the sole 5, i.e., at its heel side and toe side, with widened portions 52A and 52B respectively. Accordingly, the weight can be dispersed to both ends of the sole 52, or to both ends of the head 2.

In FIG. 22 showing a fifteenth embodiment, the sole member 52 is only formed at its heel 53 side with a widened portion 52A, while in FIG. 23 showing a sixteenth embodiment, the sole member 52 is only formed at the other side opposite to the heel 53 with a widened portion 52B, so that the more weight may be distributed to the heel side or the other opposite side respectively. Thus, with the widened portion 52A or 52B provided at only one end of the longitudinal length of the sole member 52, the weight distribution of the head 2 can be biased toward one end of the longitudinal length thereof, whereby counter measures to overcome hooking or slicing tendency of balls can be suitably taken.

Figure 24:
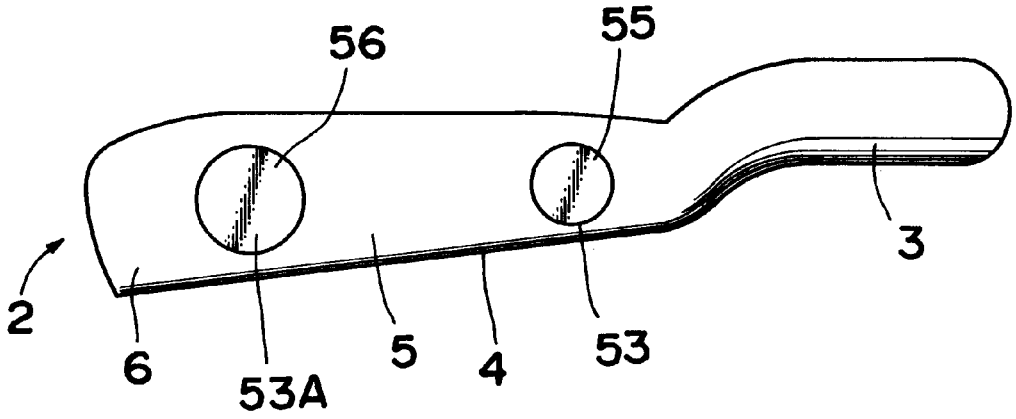
FIG. 24 is a bottom view of a golf club of a seventeenth embodiment of the invention.
Figure 25:
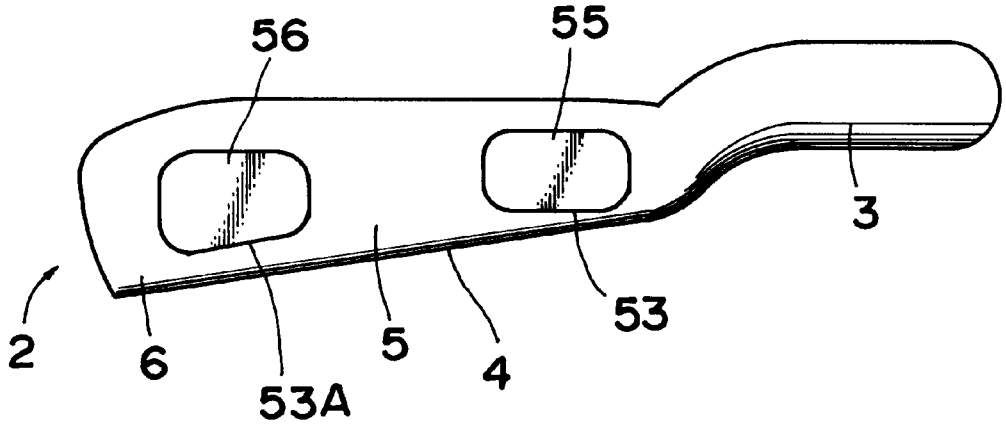
FIG. 25 is a bottom view of a golf club of an eighteenth embodiment of the invention.

In FIGS. 24 and 25 showing seventeenth to eighteenth embodiments of the invention, the sole 5 of the head body 6 formed with the hosel 3 is provided at both ends of the longitudinal direction thereof with small recesses 53 and 53A. Then, small block-shaped sole members 55 and 56 that are made of metal having the larger specific gravity than that of the head body 6, heated at approximately their finishing forging temperature, are each press-fitted into the recesses 53 and 53A, respectively, to securely fit the sole members 55 and 56 to the head body 6 by plastic deformation. In this case, the sole members 55 and 56 provided in the sole 5 allow the center of gravity of the head 2 to be positioned downward, so that the depth of the center of gravity of the head 2, in other words, the distance between the face 4 and the center of gravity of the head 2 can be made longer, thus enabling the enlarging of the sweat area.

Specifically in FIG. 24 showing a seventeenth embodiment, the sole members 55 and 56 have their bottoms rounded, while in FIG. 25 showing an eighteenth embodiment, they have their bottoms formed nearly rectangular. Like the fifteenth to seventeenth embodiments, suitable counter measures can be taken against the hooking or slicing tendency by varying the weight between the sole members 55 and 56.

Incidentally, the present invention should not be limited to the foregoing embodiments. For example, although the foregoing embodiments are for iron golf club, they may apply to wood club or even putter club with a metallic head.

What is claimed is:

1. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein the peripheral surface of said cavity is provided with a slanted surface which is gradually widened as its comes closer to said face, thus forming a triangle-shaped small recess, while the bottom surface of said cavity is formed with a plurality of convex bars which are laterally elongated and spaced one another, protruding toward the rear surface of the said head body.

2. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein a tip end of the peripheral surface of said cavity is formed with a protrusion, while an edge of the back surface of said back member is formed with a cutout, said cutout being filled by collapsing said protrusion after the back member is housed in the cavity.

3. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein a neighborhood of a tip end of the peripheral surface of said cavity is formed with a convex portion, while the peripheral surface of said back member is formed with a recess, said recess being filled by collapsing said convex portion after the back member is housed in the cavity.

4. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein a recess is formed adjacent a lower end of the peripheral surface of said cavity, while the front surface of said back member is formed with a protrusion extending toward the face, said recess being filled by collapsing said protrusion after the back member is housed in the cavity.

5. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein a recess is formed adjacent a lower end of the peripheral surface of said cavity, and the bottom surface thereof is formed with a protrusion extending rearwardly, said recess being filled by collapsing said protrusion after the back member is housed in the cavity.

6. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without gaps in a region of said plastic deformation;

wherein said head body comprises a face provided on a front, while said cavity comprises: a peripheral surface formed nearly perpendicular to the face; and a bottom surface formed nearly parallel to the face, and wherein said back member comprises a peripheral surface, a front surface and a back surface which correspond to the peripheral surface, bottom surface of said cavity and the rear surface of said head body, respectively; and wherein a ring-shaped protrusion is formed on either the front surface of said back member or the bottom surface of said cavity, while a lower end of the bottom surface of said cavity is formed with a recess, said recess being filled by collapsing said ring-shaped protrusion after the back member is housed in the cavity.

7. A golf club comprising a head with a shaft connected thereto, said head comprising a metallic head body, a cavity formed on a rear surface of the head body, and a back member that is made of different metal than that of the head body and is housed in said cavity, said head body and said back member being secured to each other by plastic deformation, at least one of said head body and said back member having portions which are deformed by plastic deformation so as to allow said head body and said back member to fit closely with each other and without caps in a region of said plastic deformation;

wherein said back member is formed with a through-hole, while the rear surface of said head body is formed with a convex portion, said convex portion being press-fitted into the through-hole of said back member in a mortise and tenon joint.

8. A golf club comprising a head with a shaft connected thereto, said head comprising a metallic head body having a face formed with recess on a front, a cavity formed on a rear surface of the head body, and a face member which is opposite to the recess, and made of different metal than that of the head body, said head body and said face member being secured to each other by plastic deformation, at least of one of said head body and said face member having portions which are deformed by plastic deformation so as to allow said head body and said face member to fit closely with each other and without gaps in a region of said elastic deformation; and wherein said head body comprises a hollow portion provided rearwardly of said recess.

* * * * *

UNITED STATES PATENT AND TRADEMARK OFFICE

CERTIFICATE OF CORRECTION

PATENT NO. : 6,200,228 B1
DATED : March 13, 2001
INVENTOR(S) : Takeda

It is certified that error appears in the above-identified patent and that said Letters Patent is hereby corrected as shown below:

Column 12,
Line 32, "caps" should be -- gaps --.
Line 51, "elastic" should be -- plastic --.

Signed and Sealed this

Fifth Day of February, 2002

*Attest:*

*Attesting Officer*

JAMES E. ROGAN
*Director of the United States Patent and Trademark Office*